US006882813B2

(12) United States Patent
Lee

(10) Patent No.: US 6,882,813 B2
(45) Date of Patent: Apr. 19, 2005

(54) ROLLER SPACING DEVICE

(75) Inventor: Hyun-cheol Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 134 days.

(21) Appl. No.: 10/454,590

(22) Filed: Jun. 5, 2003

(65) Prior Publication Data

US 2004/0013448 A1 Jan. 22, 2004

(30) Foreign Application Priority Data

Jul. 19, 2002 (KR) ..... 2002-42667

(51) Int. Cl.[7] ..... G03G 15/00

(52) U.S. Cl. ..... 399/126; 399/176; 399/279; 399/313

(58) Field of Search ..... 399/126, 159, 399/176, 228, 234, 279, 281, 313, 318, 328, 339; 100/168, 176

(56) References Cited

U.S. PATENT DOCUMENTS

| | | | | | |
|---|---|---|---|---|---|
| 5,749,031 | A | * | 5/1998 | Miwa et al. | 399/228 |
| 6,035,159 | A | * | 3/2000 | Azuma et al. | 399/111 |
| 6,240,268 | B1 | * | 5/2001 | Nishiuwatoko | 399/119 |
| 6,636,712 | B1 | * | 10/2003 | Shimaoka | 399/113 |
| 6,714,752 | B1 | * | 3/2004 | Ueno et al. | 399/117 |
| 6,735,410 | B1 | * | 5/2004 | Sekiguchi | 399/269 |

FOREIGN PATENT DOCUMENTS

| | | | | | |
|---|---|---|---|---|---|
| JP | 06138759 | A | * | 5/1994 | G03G/15/08 |
| JP | 06208293 | A | * | 7/1994 | G03G/15/08 |
| JP | 08030177 | A | * | 2/1996 | G03G/21/16 |
| JP | 09292814 | A | * | 11/1997 | G03G/21/16 |
| JP | 2000066547 | A | * | 3/2000 | G03G/15/20 |

* cited by examiner

*Primary Examiner*—Robert Beatty
(74) *Attorney, Agent, or Firm*—Staas & Halsey LLP

(57) ABSTRACT

A roller spacing device roller mechanisms having rollers in close contact under a given pressure to separate first and second rollers by a constant distance to keep the rollers from touching when roller mechanisms are not used for a long period of time. The roller spacing device comprises a spacing member shiftably mounted between first and second positions on a shaft having a partial D-cut portion and associated with one of the roller members to be separated. The spacing member has a spacing nose overlapped in the second position with an outer circumferential surface of a driving gear connected to the other roller member to separate the first roller member from the second roller member by the constant distance; and a shifting unit shifting the spacing member between first and second positions on the shaft. With this construction, the first and second roller members are separated by a constant distance to keep each roller from touching when the roller mechanism is not driven for a long period of time so as to solve several problems which may be generated when the roller members are in contact under a given pressure for a long period of time.

17 Claims, 11 Drawing Sheets

ROLLER SPACING DEVICE

CROSS-REFERENCE TO RELATED APPLICATIONS

This application claims the benefit of Korean Application No. 2002-42667, filed Jul. 19, 2002, in the Korean Intellectual Property Office, the disclosure of which is incorporated herein by reference.

BACKGROUND OF THE INVENTION

1. Field of the Invention

The present invention relates to a roller spacing device to separate rollers by a constant distance so as to keep the rollers from touching each other. In particular, the roller spacing device is used in an image forming system having roller mechanisms which rotate in close contact under a given magnitude of pressure in an operating relationship between a photosensitive medium and a developing roller, between a photosensitive medium and a transferring roller, or between a photosensitive medium and a charging roller, and functions to separate the rollers by a constant distance so as to keep the rollers from touching each other when roller mechanisms are not used for a period of time.

2. Description of the Related Art

In a roller mechanism, more particularly, a roller mechanism having first and second roller members in close contact and rotating under a given pressure, each of the roller members is kept in contact under a given pressure regardless of their operation. Therefore, if at least one of the roller members is made of an elastic material such as rubber, leaving the roller members in contact under a pressure for a period of time may cause a permanent compressive deformation to the elastic roller member and distort its profile, so that the roller members may fail to achieve a desired effect.

In particular, in the case of a developing roller, a transferring roller or a charging roller provided in an electrophotographic image forming system, each roller is rotated in contact with an OPC drum as a photosensitive medium under a certain pressure. These rollers are also made of elastic rubber due to their properties. Therefore, when the image forming system is stored for a long time without being used, the rollers are subjected to profile distortion owing to the above-mentioned permanent compressive deformation, thereby having a fatal influence on an image. In addition, a low molecular organic substance which is a component of the developing, transferring and charging rollers may ooze onto the roller surface and mix with a developing agent so that a defective image may be generated.

An electrophotographic image forming system having such a roller mechanism will be described below with reference to FIGS. 1 and 2.

Referring to FIG. 1, the reference numeral 10 is an OPC drum functioning as a photosensitive medium, 20 is a charging device, 30 is a light exposure device, 40 is a developing device, 50 is a transferring device, 60 is a fusing device, 70 is a sheet feeder, and 80 is a body frame.

In this general electrophotographic image forming system, when a printing signal is inputted, discharge of the charging device 20 electrically and uniformly charges the surface of the OPC drum 10. The light exposure device 30 transforms an image signal from a computer or a scanner into a light signal, which is scanned into the OPC drum. This forms an electrostatic latent image in the OPC drum 10 in response to the image signal. Thereafter, the developing device 40 attaches toner to the area of the electrostatic latent image of the OPC drum so that the electrostatic latent image develops into a visible image with toner. When a printing sheet P fed from the sheet feeder 70 enters the transferring device 50, the toner image of the OPC drum 10 is transferred to the printing sheet P under a high voltage applied to the transferring device 50. The toner image transferred onto the printing sheet P is fused on the printing sheet P under heat and pressure while passing through a fusing device 60, and then the printing sheet P is discharged out of the system by a sheet discharging roller 90.

As shown in FIG. 2, the developing device 40 includes a toner vessel 41, a developing roller 42, a toner feed roller 43 and a constraint blade 44. Toner is fed onto the developing roller 42 by the toner feed roller 43, and then as the developing roller 42 rotates, the toner is transported into a developing nip N formed under contact between the developing roller 42 and the OPC drum 10. Here, toner is maintained in the form of a layer having a uniform thickness on the developing roller 42 by the constraint blade 44 which is fitted on the upper portion of the developing roller 42, and the toner layer is attached to the area of the electrostatic latent image of the OPC drum 10 so that the visible toner image is formed on the OPC drum 10.

Meanwhile, the developing device 40 is designed to apply a given pressure to its opposite ends so as to form the developing nip N between the developing roller 42 and the OPC drum 42 so that the OPC drum 10 contacts the developing roller 42 under a given magnitude of pressure. Accordingly, the developing roller 42 is generally made of an elastic rubber roller.

In the developing device 40 operated in such a contact developing way, as shown in FIG. 2, the OPC drum 10 and the developing roller 42 rotate in an opposite direction with respect to each other, maintaining the given developing nip N. The developing nip N is determined by pressure applied to the opposite ends of the developing device 40 including the developing roller 42. Until the developing device is delivered to a consumer after assembly, inspection and packing in a corresponding production line, the OPC drum 10 and the developing device 42 are in contact with a certain amount of pressure in their non-operative conditions.

The developing device described above is assembled in the production line and takes a long time until it is transferred to a common consumer. In particular, in a long distance export, the developing device takes a considerable time since it passes along various logistic systems. Therefore, if the developing device is stored without use for a long period of time, the developing roller 42, made of elastic rubber, is subjected to permanent compressive deformation at the developing nip N, resulting in roller profile distortion. In this way, such roller profile distortion deteriorates image quality, e.g., causing at least one horizontal band to be formed in the image. In particular, if the developing device is kept at a high temperature for a long time, the developing nip is under both heat and pressure. Then, a high viscous low molecular organic substance, that is a component in the developing roller, is extruded from the surface of the developing roller to mingle with the toner on the developing roller to form at least one horizontal band on the image, resulting in defective images. Accordingly, the above problems need to be improved.

Furthermore, the transferring roller and the charging roller constructed in the transferring device 50 and the charging device 20 in the general image forming system also come into contact with the OPC drum 10 in the same way as the developing roller 42. Therefore, the transferring roller or the charging roller tends to have the same problems as the developing roller.

SUMMARY OF THE INVENTION

Accordingly, it is an aspect of the present invention to provide a roller spacing device used with roller mechanisms having rollers in close contact under a given pressure to separate the rollers by a constant distance to keep the rollers from touching each other when roller mechanisms are not used for a long period of time.

It is another aspect of the present invention to provide a developing roller spacing device in an image forming system to maintain the photosensitive medium and the developing roller at a fixed spacing distance in order to prevent roller profile distortion resulting from the permanent compressive deformation of the developing roller and ooze of a low molecular organic substance having a high viscosity from the roller surface when the image forming system is not used for a long period of time.

It is yet another aspect of the present invention to provide a transferring roller spacing device in an image forming system to maintain the photosensitive medium and the transferring roller at a fixed spacing distance in order to prevent roller profile distortion resulting from permanent compressive deformation of the transferring roller and the like when the image forming system is not used for a long period of time.

It is another aspect of the present invention to provide a charging roller spacing device in an image forming system to maintain the photosensitive medium and the charging roller at a fixed spacing distance in order to prevent roller profile distortion resulting from permanent compressive deformation of the charging roller and the like when the image forming system is not used for a long period of time.

Additional aspects and advantages of the invention will be set forth in part in the description which follows and, in part, will be obvious from the description, or may be learned by practice of the invention.

The foregoing and/or aspects of the present invention are achieved by providing a roller spacing device separating first and second roller members at a fixed distance to keep the first and second roller members from touching each other when the roller mechanism is not used for a long period of time in a roller mechanism having first and second roller members in contact under a given pressure.

According to an aspect of the present invention, the roller spacing device comprises a spacing member shiftably mounted between first and second positions on a shaft having a partial D-cut portion of any one of the first and second roller members, and the spacing member having a spacing nose overlapped in the second position with an outer circumferential surface of a driving gear connected to the other roller member to separate the first roller member from the second roller member at a constant distance; and a shifting unit shifting the spacing member between first and second positions on the shaft.

In the roller spacing device, the spacing member comprises: first to fourth catch steps formed in pairs to face each other in a diametrical direction on the opposite sides; and first and second spiral taped surface portions formed between the first and second catch steps and between the third and fourth catch steps, respectively.

In the roller spacing device, the shifting unit comprises: a first rotating element having first and second rotating steps caught by the first and second catch steps to be idled on the shaft, and a gear portion engaged into the driving gear on the outer circumferential surface; and a second rotating element having third and fourth rotating steps caught by the third and fourth catch steps to integrally rotate along with the shaft on the D-cut portion.

Therefore, the rotation of the second rotating element allows the spacing member to be shifted into the second position, and the rotation of the first rotating element allows the spacing member to be shifted into the first position.

In addition, the roller spacing device may further comprise a rotating knob connected to the D-cut portion to rotate the shaft, wherein the second rotating element is rotated by an operator's manipulation of the rotating knob, and the first rotating element is rotated by the driving gear.

With this construction, the first and second roller members are separated at a constant distance to keep each other untouched when the roller mechanism is not driven for a long period of time so as to solve several problems which may be generated, since the roller members are in contact under a given pressure in their rest state for a long period of time.

The foregoing and/or other aspects of the present invention may also be achieved by providing a developing roller spacing device in an eletrographic image forming system comprising: a spacing member shiftably mounted between first and second positions on a shaft with a partial D-cut portion of any one of first and second roller members, wherein the spacing member includes a spacing nose overlapped in the second position with an outer circumferential surface of a driving gear connected to the other roller member to separate the first roller member from the second roller member by the constant distance, first to fourth catch steps formed in pairs to face each other in a diametrical direction on the opposite sides, and first and second spiral taped surface portions formed between the first and second catch steps and between the third and fourth catch steps, respectively; a first rotating element having first and second rotating steps caught by the first and second catch steps to be idled on the shaft, and a gear portion engaged with the driving gear on the outer circumferential surface; and a second rotating element having third and fourth rotating steps caught by the third and fourth catch steps to integrally rotate along with the shaft on the D-cut portion.

With this construction, while the developing device is not driven for a long period of time until it is transferred to the consumer, the OPC drum and the developing roller do not come into contact so as to prevent roller profile distortion resulting from permanent compressive deformation and ooze of a low molecular organic substance having a high viscosity from the roller surface and the like, which may be generated by leaving the OPC drum and the developing roller touching each other for a long period of time.

The foregoing and/or other aspects of the present invention may also be achieved by providing a transferring roller spacing device in an eletrophotographic image forming system comprising: a spacing member installed shiftably between first and second positions on a shaft with a D-cut portion cut in part of any one of first and second roller members, wherein the spacing member includes a spacing nose overlapped in the second position with an outer circumferential surface of a driving gear connected to the other roller member to separate the first roller member from the second roller member by the constant distance, first to fourth catch steps formed in pairs to face each other in a diametrical direction on the opposite sides thereof, and first and second spiral taped surface portion formed between the first and second catch steps and between the third and fourth catch steps, respectively; a first rotating element having first and second rotating steps caught by the first and second catch steps to be idled on the shaft, and a gear portion engaged into the driving gear on the outer circumferential surface; and a second rotating element having third and fourth rotating steps caught by the third and fourth catch steps and to integrally rotate along with the shaft on the D-cut portion.

According to this construction, while the transferring device is not driven for a long period of time until it is transferred to a consumer, the OPC drum and the transferring roller do not come into contact so as to prevent roller profile distortion resulting from permanent compressive deformation and ooze of a low molecular organic substance having a high viscosity from the roller surface and the like, which may be generated by leaving the OPC drum and the transferring roller touching for a long period of time.

The foregoing and/or other aspects of the present invention may also be achieved by providing a charging roller spacing device in an eletrophotographic image forming system comprising: a spacing member shiftably mounted between first and second positions on a shaft having a D-cut portion cut in part of any one of first and second roller members, wherein the spacing member includes a spacing nose overlapped in the second position with an outer circumferential surface of a driving gear connected to the other roller member to separate the first roller member from the second roller member by a constant distance, first to fourth catch steps formed in pairs to face each other in a diametrical direction on the opposite sides thereof, and first and second spiral taped surface portions formed between the first and second catch steps and between the third and fourth catch steps, respectively; a first rotating element having first and second rotating steps caught by the first and second catch steps to be idled on the shaft, and having a gear portion engaged into the driving gear on the outer circumferential surface; and a second rotating element having third and fourth rotating steps caught by the third and fourth catch steps to integrally rotate along with the shaft on the D-cut portion.

According to this construction, while the charging device is not driven for a long period of time until it is transferred to the consumer, the OPC drum and the charging roller do not come into contact so as to prevent roller profile distortion resulting from permanent compressive deformation and ooze of a low molecular organic substance with a high viscosity from the roller surface and the like, which may result from leaving the OPC drum and the charging roller touching each other.

BRIEF DESCRIPTION OF THE DRAWINGS

These and other objects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
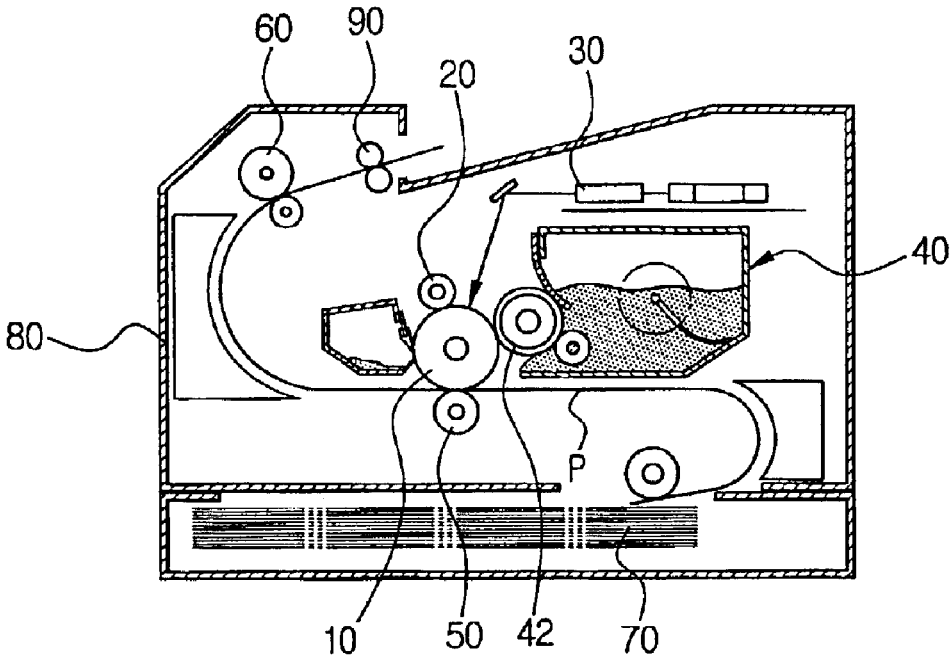
FIG. 1 (PRIOR ART)
FIG. 1 is a schematic sectional view of a general electrophotographic image forming system.
Figure 2:
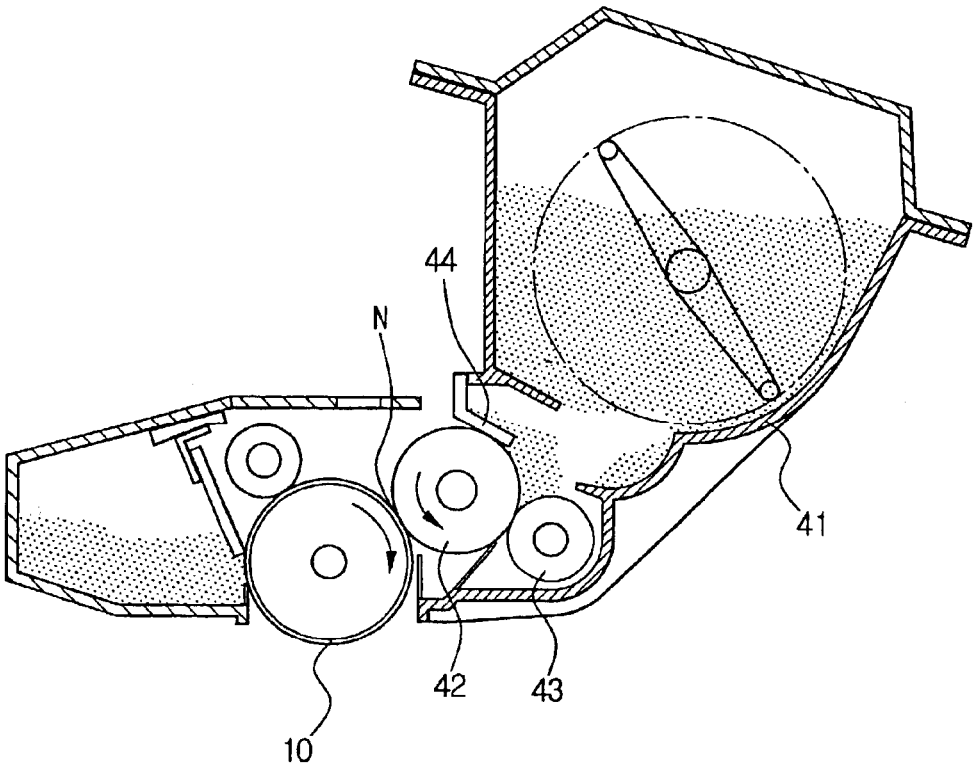
FIG.2 (PRIOR ART)
FIG. 2 is a partial sectional view taken from the image forming system shown in FIG. 1.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 3:
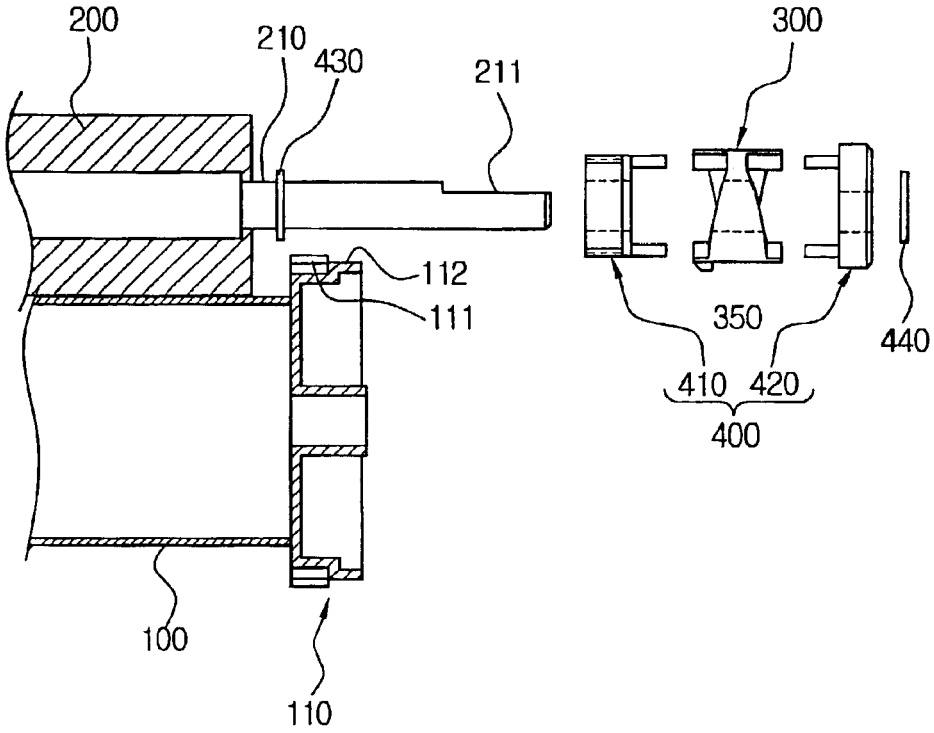
FIG. 3 is an exploded sectional view of a roller spacing device according to an embodiment of the present invention applied to the electrophotographic image forming system of FIG. 1.

With reference to FIG. 3, reference numeral 100 indicates an OPC drum or a photosensitive medium functioning as a first roller member, 200 indicates a developing roller functioning as a second roller member, 300 indicates a spacing member, and 400 indicates a shifting unit moving the spacing member 300.

As shown in FIG. 3, the OPC drum 100 and the developing roller 200 are designed to closely contact and rotate under a given pressure by a pressing means (not shown) for the developing roller. The OPC drum 100 is provided with a driving gear 110 to drive the OPC drum. The driving gear 110 is provided with a gear portion 111 and a step portion 112 on its outer circumferential surface. A shaft 210 of the developing roller 200 is provided with a D-cut portion 211 on its end.

Figure 4:
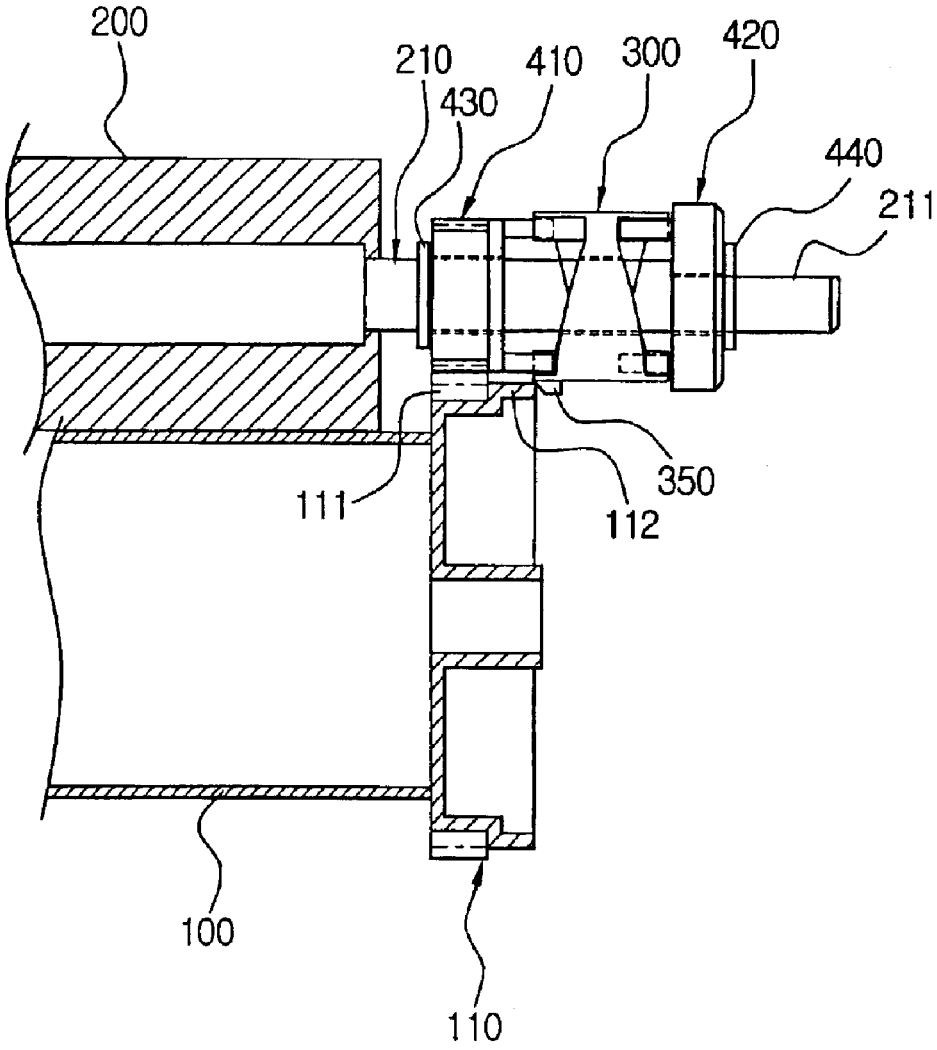
FIG. 4 is an assembled sectional view of the roller spacing device shown in FIG. 3, in which an OPC drum and a developing roller are closely rotated.
Figure 5:
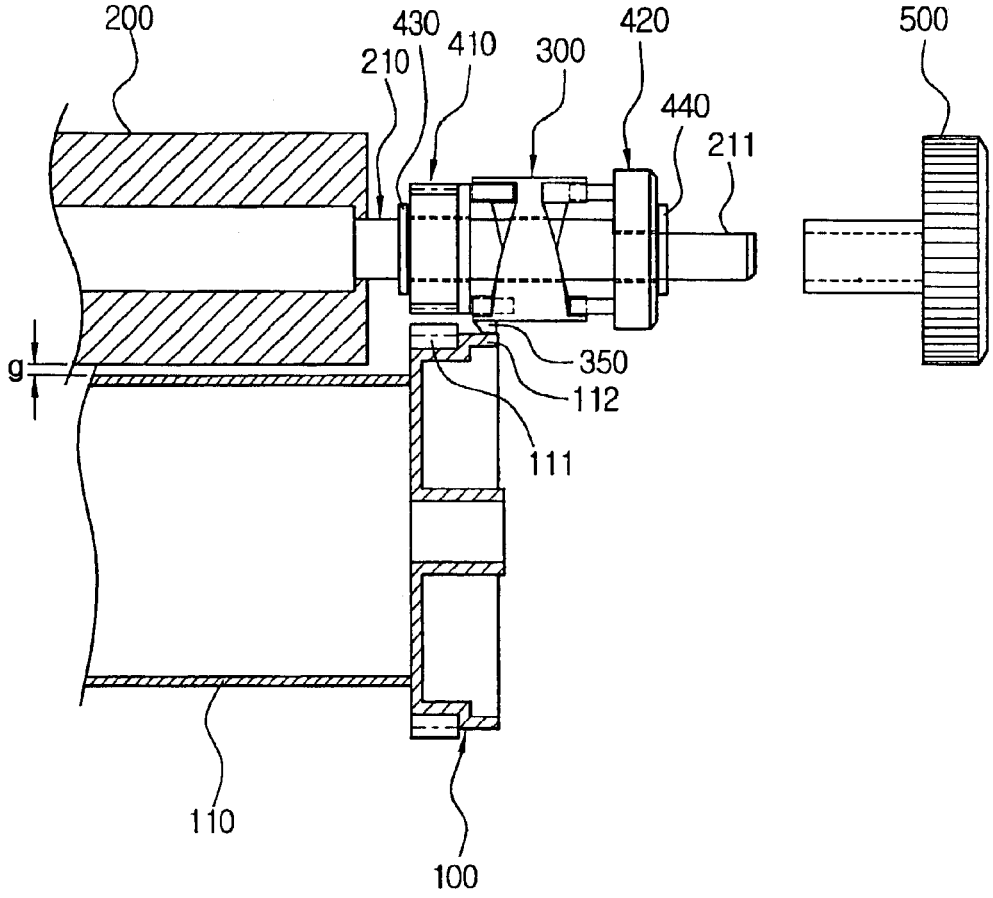
FIG. 5 is a sectional view of the OPC drum and the developing roller separated from each other by a fixed distance.
Figure 6A:
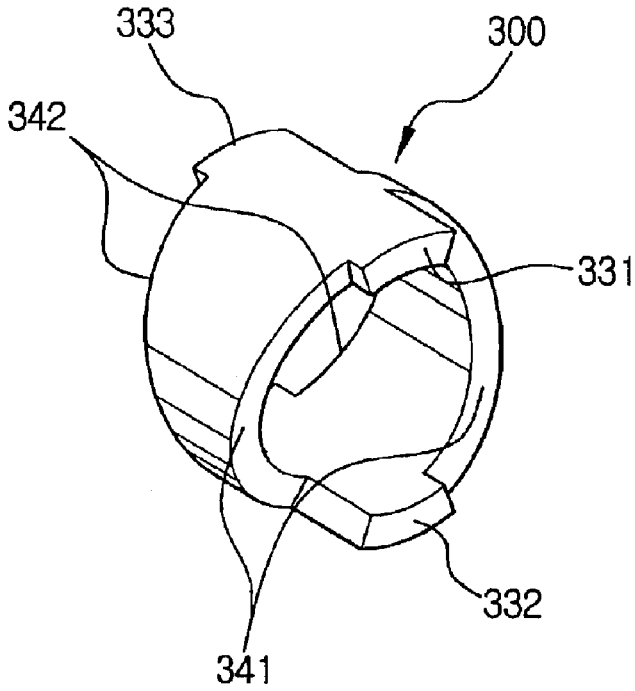
FIGS. 6A to 6D are views showing a spacing member of the roller spacing device of FIG. 3.
Figure 6B:
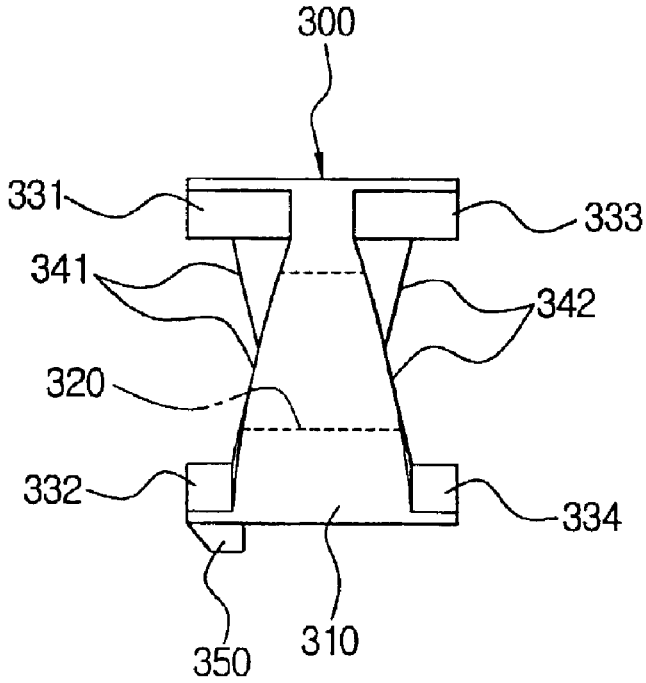
Figure 6C:
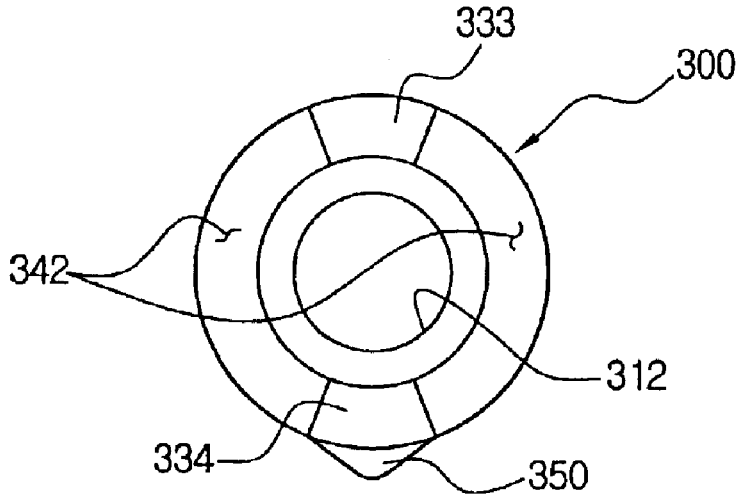
Figure 6D:
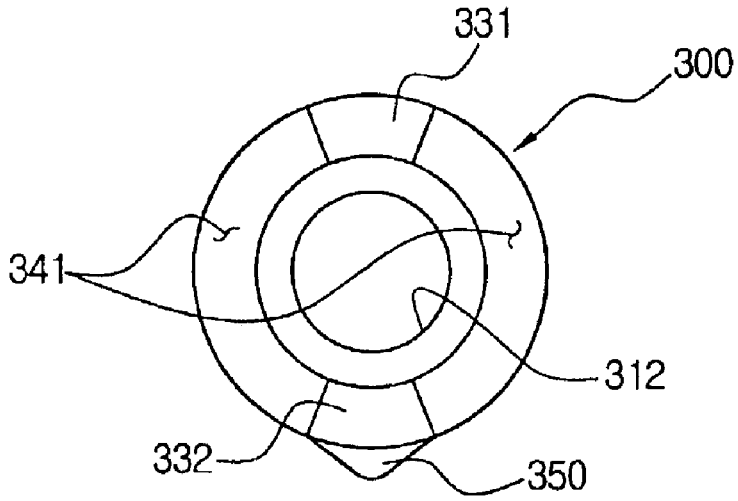

The spacing member 300 is mounted on the shaft 210 so that the spacing member can be shifted between the first position and the second position. The spacing member 300 is provided with a spacing nose 350 which causes the developing roller 200 to be separated from the OPC drum 100 by a certain distance g (refer to FIG. 5) when the spacing member 300 is overlapped with the step portion 112 of the driving gear 110 of the OPC drum 100 at the second position. Herein, the first position is a position where the developing roller 200 is not separated from the OPC drum 100 as shown in FIG. 4, while the second position is a position where the developing roller 200 is separated from the OPC drum 100 as shown in FIG. 5. In addition, the spacing member 300 has a shaft hole 320 in the middle portion of its body 310, and first and second catch steps 331 and 332 and third and fourth catch steps 333 and 334 which are formed in pairs to face each other in a diametrical direction on its opposite sides thereof, as shown in FIGS. 6A to 6D. Meanwhile, the first spiral tapered surface portion 341 is formed between the first and second catch steps 331 and 332, and the second spiral tapered surface portion 342 is formed between the third and fourth catch steps 333 and 334. Each of the tapered surface portions 341 and 342 is formed into one section with a crest portion and a bottom portion formed in a rotation symmetry structure. Each pair of the catch steps 331 and 332; 333 and 334 are arranged in the boundary between the tapered surface portions 341 and 342, which are formed into two symmetrical sections.

The spacing member 300 as set forth above is shifted between the first position and the second position on the shaft 210 by the shifting unit 400 for the spacing member. This spacing member shifting unit 400 includes a first rotating element 410 and a second rotating element 420.

The first rotating element 410 is installed on the shaft 210 in an idle rotatable manner, while the second rotating element 420 is installed on the D-cut portion 211 of the shaft 210 to integrally rotate along with the shaft 210. Furthermore, the first and second rotating elements 410 and 420 are firmly secured respectively by fastening elements 430 and 440 so that the first and second rotating elements 410 and 420 do not travel in the axial direction.

Figure 7A:
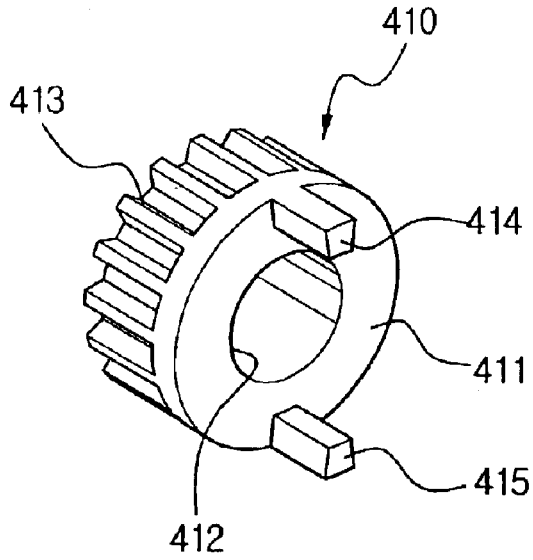
FIGS. 7A to 7C are views showing the first rotating element of the roller spacing device of FIG. 3.
Figure 7B:
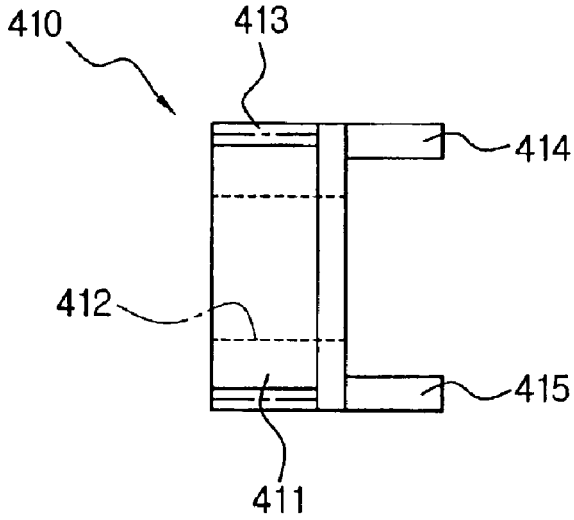
Figure 7C:
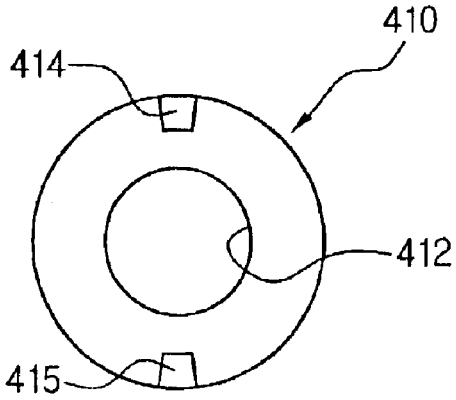

As shown in FIGS. 7A to 7C, the first rotating element 410 is provided with a shaft hole 412 in a central portion of its body 411 and a gear portion 413 meshing with the gear portion 111 of the driving gear 110 in its outer circumferential surface. In addition, the first rotating element 410 is provided with first and second rotating steps 414 and 415 on one side, in particular, the side facing the spacing member 300. The first and second rotating steps 414 and 415 protrude at a given height and are caught by the first and second catch steps 331 and 332.

Figure 8A:
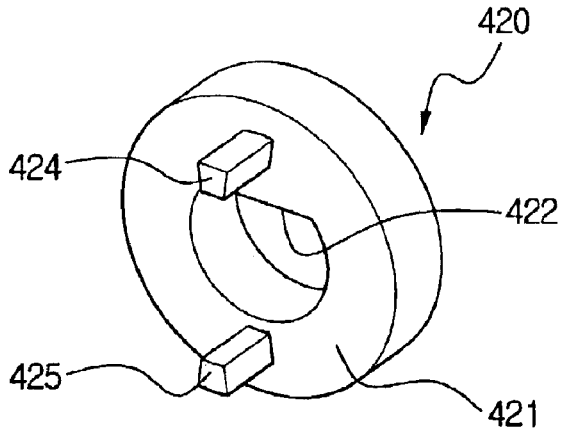
FIGS. 8A to 8C are views showing the second rotating element of the roller spacing device of FIG. 3.
Figure 8B:
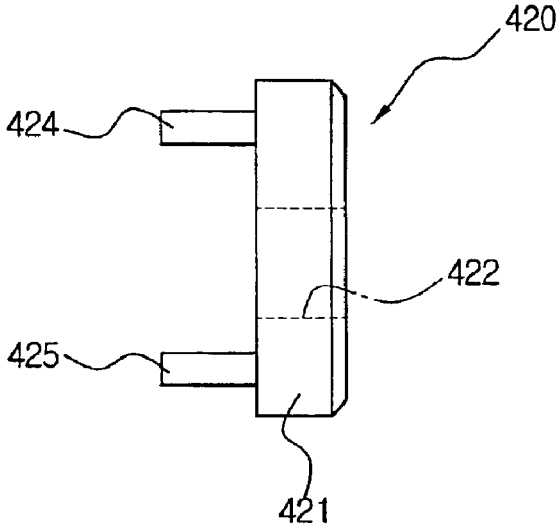
Figure 8C:
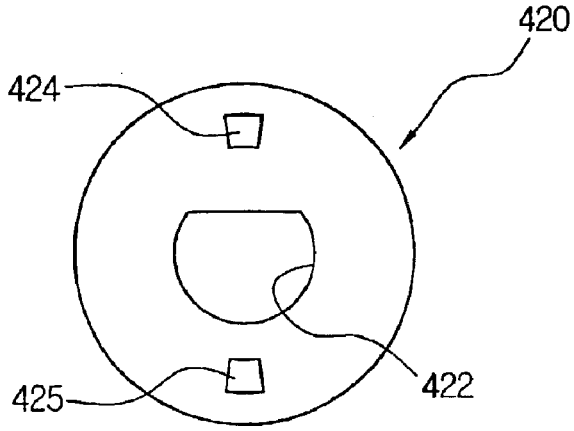

As shown in FIGS. 8A to 8C, the second rotating element 420 is provided with a shaft hole 422 corresponding to the D-cut portion 211 of the shaft 210 in a middle portion of its body 421, and the third and fourth rotating steps 424 and 425 in one side, in particular, facing the spacing member 300. The third and fourth rotating steps 424 and 425 also protrude at a given height and are caught by the third and fourth catch steps 333 and 334.

The first to fourth rotating steps 414, 415, 424 and 425 are assembled with the first to fourth catch steps 331, 332, 333 and 334 in contact with each other, in which their ends come into contact with the bottoms of the first and second tapered surface portions 341 and 342 of the spacing member 300. Therefore, when the second rotating element 420 is rotated, the third and fourth rotating steps 424 and 425 of the second rotating element 420 are rotated along the second tapered surface portion 342, and thus the spacing member 300 is shifted into the second position on the shaft 210. Meanwhile, when the first rotating element 410 is rotated, the first and second rotating steps 414 and 415 of the first rotating element 410 are rotated along the first tapered surface portion 341, and thus the spacing member 300 is shifted into the first position on the shaft 210.

Here, the second rotating element 420 is rotated by an operator. To this end, the developing roller spacing device is provided with a rotating knob 500 inserted into the D-cut portion 211 of the shaft 210, as shown in FIG. 5. When the rotating knob 500 is inserted into the shaft 210 to perform a rotation, the shaft 210 is rotated in the same direction as the second rotating element 420. The first rotating element 410 is rotated owing to rotation of the OPC drum 100 during operation of the image forming system.

The operation of the developing roller spacing device of the image forming system as constructed above will be described below with reference to FIGS. 4 to 5 and 9A to 9C.

The developing device, which has been assembled in the production line, performs to test printing in a small amount for the purpose of image quality inspection and the like. The OPC drum 100 and the developing roller 200 are then closely in contact and rotated under a pressure by shifting the spacing member 300 into the first position, as shown in FIG. 4.

The developing device, packed after the inspection process, is stored without driving for a long period of time until it is handed over to a consumer. In this case, a variety of problems take place since the OPC drum 100 and the developing roller 200 are left in contact with each other. These and other problems are solved by maintaining the OPC drum 100 and the developing roller 200 untouched using the roller spacing device according to the embodiments of the present invention.

Figure 9A:
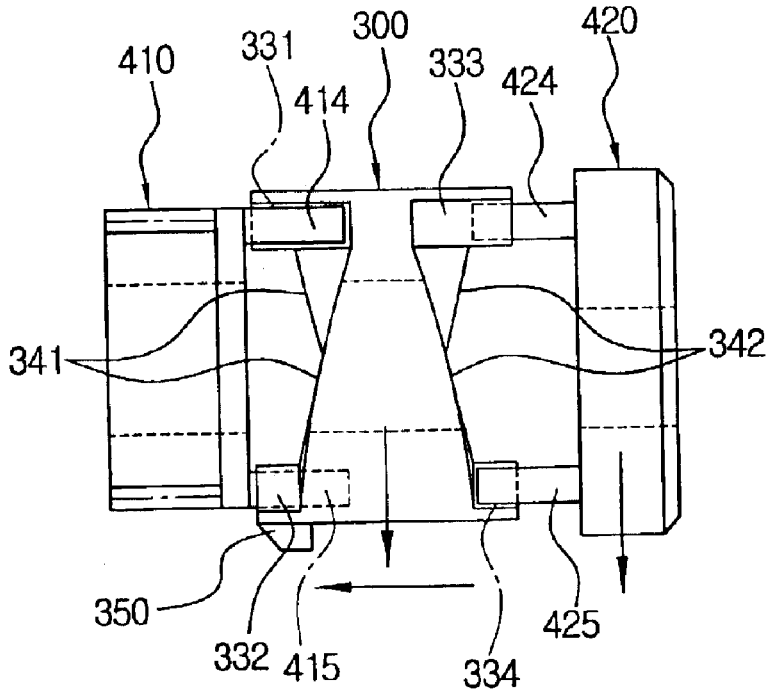
FIGS. 9A to 9C are sectional views illustrating the operation of the roller spacing device of FIG. 3.

More particularly, the first rotating element 410 is inserted over the shaft 210 of the developing roller in the developing device to rotate in the counter clockwise direction, and then the second rotating element 420 is rotated in the counter clockwise direction along with the shaft 210. At this time, the third and fourth rotating steps 424 and 425 of the second rotating element 420 are subject to rotation along the second tapered surface portion 342 of the spacing member 300, causing the spacing member 300 to shift from left to right as shown in FIG. 9A, i.e., into the second position on the shaft 210. This position displacement causes the spacing nose 350 of the spacing member 300 to be overlapped with the step portion 112 of the driving gear 110 of the OPC drum 100, as seen in FIG. 5, allowing the developing roller 200, which has come into contact with the OPC drum 100, to be separated by a height of the spacing nose.

The developing device assembled and packed as above can keep the rollers spaced or separated until it is delivered to the consumer.

Figure 9B:
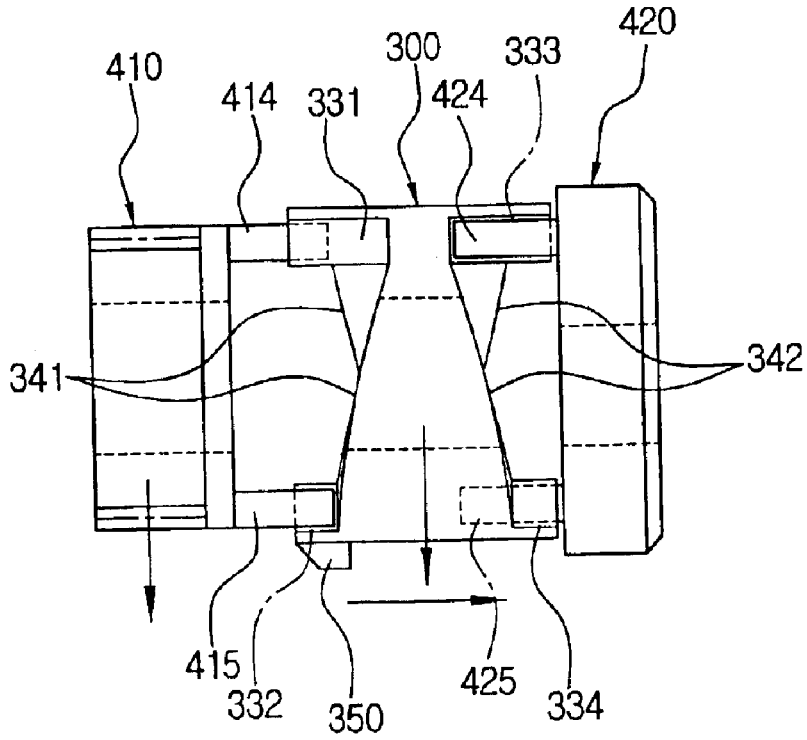

When the developing device is handed over to the consumer and mounted on the image forming system and supplied with electric power by the consumer, a main driving device of the image forming system is operated to generate a driving force. The driving force is transmitted into the first rotating element 410 via the driving gear 110 of the OPC drum 100, and thus the first rotating element 410 is rotated in the counter clockwise direction, as shown in FIG. 9B. In this case, the first and second rotating steps 414 and 415 of the first rotating element 410 are rotated along the first tapered surface portion 341 of the spacing member 300, allowing the spacing member 300, disposed in the second position on the shaft 210, to shift into the first position. This position displacement of the spacing member 300 causes the spacing nose 350 to be removed from the step portion 112 of the driving gear 110 of the OPC drum 100 so that the developing roller 200 comes into contact with the OPC drum 100 again from the separated position. In this case, because the third and fourth rotating steps 424 and 425 cannot be caught by the third and fourth catch steps 333 and 334 of the spacing member 300 until the spacing member 300 rotates to 180 degrees, the second rotating element 420 and the developing roller 200 cannot be rotated.

Then, when the first rotating element 410 is rotated more than one turn, the spacing member 300 is rotated more than 180 degrees, causing the third and fourth rotating steps 424 and 425 of the second rotating element 420 to be caught by the third and fourth catch steps 333 and 334 of the spacing member 300, so that a rotation force of the first rotating element 410 is transmitted to the second rotating element 420. Thus, the developing roller 200 is rotated in a counter clockwise direction along with the second rotating element 420, as shown in FIG. 9C.

That is to say, as shown in FIG. 4, the OPC drum 100 and the developing roller 200 are in close contact and rotated so that a given developing process is performed.

Figure 9C:
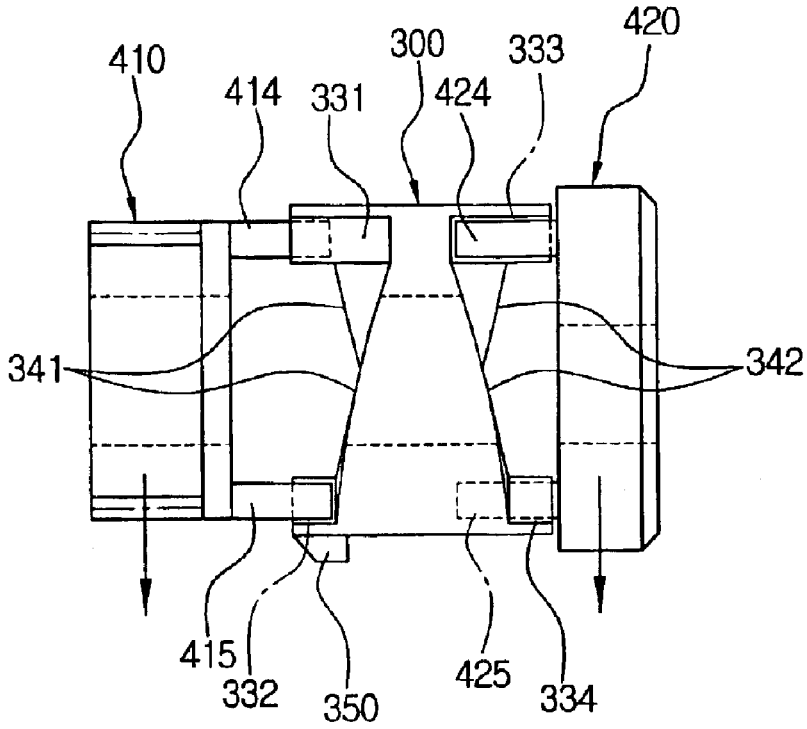

In case that the completion of the printing operation brings the main driving device of the image forming system to a stop, unless the operator rotates the shaft 210 of the developing roller 200 as intended using the rotating knob 500, the first and second rotating steps 414 and 415 of the first rotating element 410, the third and fourth rotating steps 424 and 425 of the second rotating element 420 and the spacing nose 350 of the spacing member 300 cooperating with these steps are kept in the state as shown in FIG. 9C. Therefore, when the main driving device is operated again, the driving force of the main driving device is directly transmitted into the developing roller 200 without generating any operational problem.

As described above, the roller spacing device according to this embodiment of the present invention can separate the OPC drum and the developing roller by a particular distance to keep them from touching each other by a simple operation of rotating the shaft of the developing roller using the rotating knob. Therefore, the problematic phenomena, such as profile distortion of the developing roller and the like, can be prevented, which are generated by leaving the OPC drum and the developing roller unused for a long period of time.

In addition, the roller spacing device according to the embodiments of the present invention can be manipulated in the same manner as the conventional image forming system without any special operation of the consumer so as to bring the developing roller into contact with the OPC drum or remove the developing roller from the OPC drum. Therefore, the convenience of using the image forming system is not reduced and the problematic phenomena in the conventional image forming system, for example roller profile distortion, can be eliminated.

While it has been illustrated and described that the roller spacing device according to the embodiments of the present invention is applied to the developing roller of the image forming device, the roller spacing device according to the embodiments of the present invention may be applied to a transferring roller and/or a charging roller in the image forming system. It can be also applied to roller mechanisms of various kinds which are rotated in close contact under a certain pressure, some electric or electronic products with these roller mechanisms and the like.

As set forth above, the present invention can maintain the first and second roller members as spaced at a constant distance and kept from touching when the roller mechanism is not driven for a long period of time so as to prevent a problematic phenomen on such as roller profile distortion which may be generated since the roller members are in contact with each other under a certain pressure in a non-operative position for a long period of time.

In particular, in the case that the roller spacing device according to the embodiments of the present invention is applied to at least one of the developing, transferring and charging rollers in the image forming system, even though the developing device, the transferring device and the charging device are not driven for a long period of time until they are delivered to the consumer, the OPC drum and the developing roller, the OPC drum and the transferring roller or the OPC drum and the charge roller do not come into contact. This prevents the problematic phenomena such as roller profile distortion resulting from permanent compressive deformation, ooze of a low molecular organic substance with a high viscosity from the roller surface and the like, which may be generated by leaving the OPC drum and the developing roller, the OPC drum and the transferring roller, and the OPC drum and the charging roller touching each other for a long period of time.

Therefore, any defective image can be avoided, which is generated by the roller profile distortion phenomenon or the ooze of low molecular organic substance from the roller surface as set forth above, and a stable image quality can be secured.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A roller mechanism having first and second roller members rotating in contact under a given pressure, a roller spacing device to separate the first and second roller members by a fixed distance to keep the first and second roller members from touching each other when the roller mechanism is not in use, comprising:

a spacing member shiftably mounted between first and second positions on a shaft having a partial D-cut portion and associated with one of the first and second roller members, and the spacing member having a spacing nose overlapped in the second position with an outer circumferential surface of a driving gear connected to the other roller member to separate the first roller member from the second roller member by a constant distance; and a shifting unit shifting the spacing member between the first and second positions on the shaft.

2. The roller spacing device according to claim 1, wherein the spacing member further comprises:

first, second, third and fourth catch steps formed in pairs to face each other in a diametrical direction on opposite sides thereof; and first and second spiral tapered surface portions formed between the first and second catch steps and between the third and fourth catch steps, respectively, wherein the shifting unit comprises:

a first rotating element having first and second rotating steps caught by the first and second catch steps to be idled on the shaft;

a gear portion associated with the driving gear on an outer circumferential surface thereof; and a second rotating element having third and fourth rotating steps caught by the third and fourth catch steps to integrally rotate along with the shaft on the partial D-cut portion, and wherein the rotation of the second rotating element allows the spacing member to be shifted to the second position and the rotation of the first rotating element allows the spacing member to be shifted to the first position.

3. The roller spacing device according to claim 2, further comprising a rotating knob connected to the D-cut portion to rotate the shaft, wherein the second rotating element is rotated by manipulation of the rotating knob, and the first rotating element is rotated by the driving gear.

4. The roller spacing device according to claim 1, wherein the first roller member is an OPC drum of an electrophotographic image forming system and the second roller member is a developing roller.

5. The roller spacing device according to claim 1, wherein the first roller member is an OPC drum of an electrophotographic image forming system and the second roller member is a transferring roller.

6. The roller spacing device according to claim 1, wherein the first roller member is an OPC drum of an electrophotographic image forming system and the second roller member is a charging roller.

7. An eletrophotographic image forming system having an OPC drum with a driving gear, and a developing roller provided to be in contact with an OPC drum under a given pressure to develop electrostatic latent images of the OPC drum, comprising:

a developing roller spacing device to separate the OPC drum and the developing roller by a constant distance to keep the OPC drum and the developing roller from touching when the developing roller and OPC drum are not used, the developing roller spacing device comprising:

a spacing member shiftably mounted between first and second positions on a shaft with a partial D-cut portion and associated with the developing roller and the OPC drum, wherein the spacing member includes:

a spacing nose overlapped in the second position with an outer circumferential surface of a driving gear connected to the other one of the developing roller or OPC drum to separate the developing roller from the OPC drum by a constant distance, first, second, third and fourth catch steps formed in pairs to face each other in a diametrical direction on opposite sides of the spacing member, and first and second spiral tapered surface portions formed between the first and second catch steps and between the third and fourth catch steps, respectively;

a first rotating element having first and second rotating steps caught by the first and second catch steps to be idled on the shaft, and a gear portion engaged with the driving gear on the outer circumferential surface; and a second rotating element having third and fourth rotating steps caught by the third and fourth catch steps to integrally rotate along with the shaft on the partial D-cut portion, wherein the rotation of the second rotating element allows the spacing member to be shifted to the second position and the rotation of the first rotating element allows the spacing member to be shifted to the first position.

8. The developing roller spacing device according to claim 7, further comprising a rotating knob connected to the partial D-cut portion to rotate the shaft such that the second rotating element is rotated by an operator's manipulation of the rotating knob, and the first rotating element is rotated by the driving gear.

9. An eletrophotographic image forming system having an OPC drum with a driving gear, and a transferring roller provided to be in contact with the OPC drum under a given pressure to transfer toner images of the OPC drum in a printing sheet, comprising:

a transferring roller spacing device to separate the OPC drum and the transferring roller by a fixed distance to keep the OPC drum and the transferring roller from touching when the transferring roller and OPC drum are not used, the transferring roller spacing device comprising:

a spacing member installed shiftably between first and second positions on a shaft with a D-cut portion cut in part of one of the transferring roller and OPC drum, the spacing member including:

a spacing nose overlapped in the second position with an outer circumferential surface of a driving gear connected to the other roller member to separate the transferring roller from the OPC drum by a constant distance, first, second, third and fourth catch steps formed in pairs to face each other in a diametrical direction on opposite sides of the spacing member, and first and second spiral tapered surface portion formed between the first and second catch steps and between the third and fourth catch steps, respectively;

a first rotating element having first and second rotating steps caught by the first and second catch steps to be idled on the shaft;

a gear portion associated with the driving gear on the outer circumferential surface; and a second rotating element having third and fourth rotating steps caught by the third and fourth catch steps to integrally rotate along with the shaft on the partial D-cut portion, wherein the rotation of the second rotating element allows the spacing member to be shifted to the second position and the rotation of the first rotating element allows the spacing member to be shifted to the first position.

10. The transferring roller spacing device according to claim 9, further comprising a rotating knob connected to the D-cut portion to rotate the shaft such that the second rotating element is rotated by manipulation of the rotating knob and the first rotating element is rotated by the driving gear.

11. An eletrophotographic image forming system having an OPC drum with a driving gear and a charging roller provided to be in contact with the OPC drum under a given pressure to charge a surface of the OPC drum with a given potential, comprising:

a charging roller spacing device to separate the OPC drum and the charging roller by a constant distance to keep the OPC drum and the charging roller from touching when the charging roller and OPC drum are not used, comprising:

a spacing member shiftably mounted between first and second positions on a shaft having a D-cut portion cut in part of one of the charging roller and OPC drum, the spacing member including:

a spacing nose overlapped in the second position with an outer circumferential surface of a driving gear connected to the other one of the charging roller or OPC drum to separate the charging roller from the OPC drum by a constant distance, first, second, third and fourth catch steps formed in pairs to face each other in a diametrical direction on the opposite sides of the spacing member, and first and second spiral taped surface portions formed between the first and second catch steps and between the third and fourth catch steps, respectively;

a first rotating element having first and second rotating steps caught by the first and second catch steps to be idled on the shaft, and having a gear portion associated with the driving gear on the outer circumferential surface; and a second rotating element having third and fourth rotating steps caught by the third and fourth catch steps to integrally rotate along with the shaft on the D-cut portion, wherein the rotation of the second rotating element allows the spacing member to be shifted to the second position and the rotation of the first rotating element allows the spacing member to be shifted to the first position.

12. The charging roller spacing device according to claim 11, further comprising a rotating knob connected to the D-cut portion to rotate the shaft such that the second rotating element is rotated by manipulation of the rotating knob and the first rotating element is rotated by the driving gear.

13. A roller mechanism to be used with first and second rollers of an eletrophotographic image forming apparatus that are in contact with each other, comprising:

a shaft having a D-cut portion therein inserted into one of the first and second rollers;

a drive gear positioned on an end of the other one of the first and second rollers;

a spacing member shiftable between first and second positions and installed on the shaft, the spacing member having a spacing nose overlapping in the second position with the drive gear to separate the first roller from the second roller by a constant distance.

14. The roller mechanism according to claim 13, wherein the spacing member further comprises:

first and second catch steps provided at opposite sides of the diameter of one end of the spacing member;

third and fourth catch steps provided at opposite sides of the diameter of the other end of the spacing member;

first and second spiral tapered surface portions formed around the spacing member between the first and second catch steps and between the third and fourth catch steps, respectively;

a first rotating element having first and second rotating steps caught by the first and second catch steps to be idled on the shaft, and having a gear portion provided in the driving gear at an outer circumferential surface; and a second rotating element having third and fourth rotating steps caught by the third and fourth catch steps to integrally rotate along with the shaft on the D-cut portion, wherein the rotation of the second rotating element allows the spacing member to be shifted to the second position and the rotation of the first rotating element allows the spacing member to be shifted to the first position.

15. The roller mechanism according to claim 14, wherein the first roller is a developing roller and the second roller is a photosensitive medium roller.

16. The roller mechanism according to claim 14, wherein the first roller is a transferring roller and the second roller is a photosensitive medium roller.

17. The roller mechanism according to claim 14, wherein the first roller is a charging roller and the second roller is a photosensitive medium roller.

* * * * *